US005125315A

United States Patent [19]

Kawashima

[11] Patent Number: 5,125,315

[45] Date of Patent: Jun. 30, 1992

[54] ELECTRONIC MUSICAL INSTRUMENT WITH SELECTION OF STANDARD SOUND PITCH OF A NATURAL INSTRUMENT UPON SELECTION OF TONE COLOR

[75] Inventor: Susumu Kawashima, Hamamatsu, Japan

[73] Assignee: Yamaha Corporation, Hamamatsu, Japan

[21] Appl. No.: 460,261

[22] Filed: Jan. 2, 1990

[30] Foreign Application Priority Data

Jan. 4, 1989 [JP] Japan ..... 64-000868

[51] Int. Cl.[5] ..... G10H 1/20

[52] U.S. Cl. ..... 84/619; 84/622; 84/657; 84/659

[58] Field of Search ..... 84/600-603, 84/619, 657, 622-625, 659-661

[56] References Cited

U.S. PATENT DOCUMENTS

| | | | |
|---|---|---|---|
| 4,038,895 | 8/1977 | Clement et al. | 84/687 X |
| 4,230,012 | 10/1980 | Bommersbach et al. | 84/657 X |
| 4,724,736 | 2/1988 | Isozaki | 84/445 X |
| 4,957,032 | 9/1990 | Hirano et al. | 84/622 |
| 4,993,307 | 2/1991 | Sakashita | 84/615 |

FOREIGN PATENT DOCUMENTS 62-24311 6/1987 Japan .

*Primary Examiner*—William M. Shoop, Jr.
*Assistant Examiner*—Brian Sircus
*Attorney, Agent, or Firm*—Spensley, Horn, Jubas & Lubitz

[57] ABSTRACT

The tonality of scale of electronic musical instrument is set by setting a standard sound pitch (sound pitch of "do"). When a tone color is selected, this setting is automatically performed according to this tone color. In the case when the tone color is similar to that of natural musical instrument, setting is executed so that the tonality of pertinent musical instrument is set.

8 Claims, 18 Drawing Sheets

Fig.3(A)

FPR

| key \ i | 0 | 1 | 2 | 3 | 4 | 5 | 6 | 7 | 8 | 9 | 10 | 11 | 12 | 13 | 14 | 15 | 16 | 17 | 18 | 19 | 20 | 21 |
|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 2 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 3 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 5 | 1 | 1 | 1 | 1 | 1 | 1 | 1 | 1 | 1 | 1 | 1 | 1 | 1 | 1 | 1 | 1 | 1 | 1 | 0 | 0 | 0 | 0 |
| 6 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 9 | 1 | 1 | 1 | 1 | 1 | 1 | 1 | 1 | 1 | 1 | 1 | 0 | 0 | 0 | 0 | 0 | 0 | 0 | 1 | 1 | 1 | 1 |
| 10 | 1 | 1 | 1 | 1 | 1 | 1 | 1 | 1 | 0 | 0 | 0 | 1 | 1 | 1 | 1 | 1 | 1 | 0 | 1 | 1 | 1 | 1 |
| 11 | 1 | 0 | 1 | 0 | 1 | 0 | 1 | 0 | 0 | 1 | 0 | 1 | 0 | 1 | 0 | 1 | 0 | 0 | 1 | 0 | 1 | 0 |
| 12 | 1 | 1 | 1 | 1 | 1 | 1 | 0 | 0 | 0 | 1 | 1 | 1 | 1 | 1 | 1 | 1 | 1 | 0 | 0 | 0 | 1 | 1 |
| 13 | 1 | 1 | 1 | 1 | 0 | 0 | 0 | 0 | 0 | 1 | 1 | 0 | 0 | 1 | 1 | 1 | 1 | 0 | 0 | 0 | 0 | 0 |
| 14 | 1 | 1 | 0 | 0 | 0 | 0 | 0 | 0 | 0 | 1 | 1 | 0 | 0 | 1 | 1 | 0 | 0 | 0 | 0 | 0 | 0 | 0 |

| key \ i | 22 | 23 | 24 | 25 | 26 | 27 | 28 | 29 | 30 | 31 | 32 | 33 | 34 | 35 | 36 | 37 | 38 | 39 | 40 | 41 | 42 | 43 |
|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 1 | 1 | 1 | 1 | 1 | 1 | 1 | 1 | 1 | 1 | 1 | 0 | 0 | 0 | 0 | 0 | 0 | 0 | 1 | 0 | 0 | 0 | 0 |
| 2 | 1 | 1 | 1 | 1 | 0 | 0 | 0 | 1 | 0 | 0 | 1 | 1 | 1 | 1 | 0 | 0 | 0 | 0 | 0 | 0 | 0 | 1 |
| 3 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 | 1 | 0 | 0 | 0 | 1 | 1 | 1 | 0 | 1 | 1 | 1 | 0 | 0 | 0 | 1 | 1 | 1 | 0 | 1 | 1 | 1 | 1 |
| 5 | 0 | 1 | 1 | 1 | 1 | 1 | 1 | 0 | 1 | 0 | 0 | 1 | 1 | 1 | 1 | 1 | 1 | 0 | 0 | 1 | 1 | 1 |
| 6 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 9 | 0 | 1 | 0 | 0 | 1 | 1 | 1 | 0 | 0 | 0 | 0 | 1 | 0 | 0 | 1 | 1 | 1 | 0 | 0 | 1 | 1 | 1 |
| 10 | 0 | 0 | 1 | 1 | 0 | 0 | 0 | 0 | 0 | 0 | 0 | 0 | 1 | 1 | 0 | 0 | 0 | 0 | 0 | 1 | 1 | 1 |
| 11 | 0 | 0 | 1 | 0 | 0 | 1 | 0 | 0 | 0 | 0 | 0 | 0 | 1 | 0 | 0 | 1 | 0 | 0 | 0 | 1 | 0 | 1 |
| 12 | 0 | 0 | 1 | 1 | 0 | 1 | 1 | 0 | 0 | 0 | 0 | 0 | 1 | 1 | 0 | 1 | 1 | 0 | 0 | 1 | 1 | 1 |
| 13 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 14 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

Fig.3(B)

FPR

| key \ i | 44 | 45 | 46 | 47 | 48 | 49 | 50 | 51 | 52 | 53 | 54 | 55 | 56 | 57 | 58 | 59 | 60 | 61 | 62 | 63 | 64 | 65 |
|---|---|---|---|---|---|---|---|---|---|---|---|---|---|---|---|---|---|---|---|---|---|---|
| 0 | 0 | 1 | 0 | 0 | 1 | 1 | 1 | 1 | 1 | 1 | 1 | 1 | 1 | 1 | 1 | 1 | 1 | 1 | 1 | 1 | 1 | 1 |
| 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2 | 1 | 1 | 1 | 0 | 1 | 1 | 1 | 1 | 1 | 1 | 1 | 1 | 1 | 1 | 1 | 1 | 1 | 1 | 1 | 1 | 1 | 1 |
| 3 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 | 1 | 1 | 1 | 1 | 1 | 1 | 1 | 1 | 1 | 1 | 1 | 1 | 1 | 1 | 1 | 1 | 1 | 1 | 1 | 0 | 0 | 0 |
| 5 | 1 | 1 | 1 | 1 | 1 | 1 | 1 | 1 | 1 | 1 | 0 | 1 | 1 | 0 | 0 | 0 | 0 | 0 | 0 | 0 | 1 | 1 |
| 6 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 9 | 1 | 1 | 1 | 1 | 1 | 1 | 1 | 0 | 0 | 0 | 1 | 0 | 0 | 0 | 1 | 1 | 0 | 0 | 1 | 1 | 1 | 1 |
| 10 | 1 | 1 | 1 | 1 | 0 | 0 | 0 | 1 | 1 | 0 | 0 | 1 | 1 | 0 | 1 | 1 | 1 | 1 | 1 | 1 | 1 | 0 |
| 11 | 0 | 0 | 0 | 0 | 1 | 0 | 0 | 0 | 0 | 0 | 0 | 1 | 0 | 0 | 1 | 0 | 1 | 0 | 0 | 0 | 0 | 1 |
| 12 | 1 | 0 | 0 | 0 | 1 | 1 | 0 | 0 | 0 | 0 | 0 | 1 | 1 | 0 | 1 | 1 | 1 | 1 | 0 | 0 | 0 | 1 |
| 13 | 0 | 0 | 0 | 0 | 0 | 0 | 0 | 0 | 1 | 0 | 0 | 1 | 1 | 0 | 0 | 0 | 0 | 0 | 0 | 0 | 1 | 1 |
| 14 | 0 | 0 | 0 | 0 | 0 | 0 | 0 | 0 | 1 | 0 | 0 | 1 | 1 | 0 | 0 | 0 | 0 | 0 | 0 | 0 | 1 | 1 |

| key \ i | 66 | 67 | 68 | 69 | 70 | 71 | 72 | 73 | 74 | 75 | 76 | 77 | 78 | 79 | 80 | 81 | 82 | 83 | 84 | 85 | 86 | 87 |
|---|---|---|---|---|---|---|---|---|---|---|---|---|---|---|---|---|---|---|---|---|---|---|
| 0 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2 | 1 | 1 | 1 | 1 | 1 | 1 | 1 | 1 | 1 | 1 | 1 | 0 | 0 | 0 | 0 | 0 | 1 | 1 | 1 | 1 | 1 | 1 |
| 3 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 | 0 | 1 | 1 | 0 | 0 | 0 | 0 | 0 | 0 | 0 | 0 | 1 | 1 | 1 | 1 | 1 | 1 | 1 | 1 | 1 | 1 | 0 |
| 5 | 1 | 1 | 1 | 1 | 1 | 1 | 1 | 1 | 1 | 1 | 1 | 1 | 1 | 0 | 0 | 0 | 0 | 0 | 0 | 0 | 0 | 0 |
| 6 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 9 | 1 | 1 | 1 | 1 | 1 | 1 | 1 | 0 | 0 | 0 | 0 | 0 | 0 | 0 | 0 | 0 | 1 | 1 | 1 | 1 | 1 | 1 |
| 10 | 0 | 1 | 1 | 0 | 0 | 0 | 0 | 0 | 0 | 0 | 0 | 1 | 1 | 1 | 1 | 0 | 1 | 1 | 0 | 0 | 1 | 0 |
| 11 | 0 | 1 | 0 | 1 | 0 | 1 | 0 | 1 | 0 | 1 | 0 | 1 | 0 | 1 | 1 | 0 | 1 | 0 | 1 | 0 | 0 | 0 |
| 12 | 1 | 1 | 1 | 1 | 1 | 1 | 1 | 1 | 1 | 1 | 1 | 1 | 1 | 1 | 1 | 0 | 1 | 1 | 1 | 1 | 0 | 0 |
| 13 | 1 | 1 | 1 | 0 | 0 | 1 | 1 | 1 | 1 | 0 | 0 | 0 | 0 | 0 | 0 | 0 | 1 | 1 | 0 | 0 | 0 | 0 |
| 14 | 1 | 1 | 1 | 0 | 0 | 0 | 0 | 1 | 1 | 0 | 0 | 0 | 0 | 0 | 0 | 0 | 1 | 1 | 0 | 0 | 0 | 0 |

Fig.4

FPS

| key \ i | 0 | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 1 | 0 | 0 | 0 | 0 | 0 | 0 | 0 | 0 | 0 | 0 | 0 | 0 | 0 | 0 | 0 | 0 | 0 | 0 | 0 |
| 2 | 1 | 1 | 1 | 1 | 1 | 1 | 1 | 1 | 1 | 1 | 1 | 1 | 1 | 1 | 1 | 1 | 1 | 1 | 1 |
| 3 | 0 | 0 | 0 | 0 | 0 | 0 | 0 | 0 | 0 | 0 | 0 | 0 | 0 | 0 | 0 | 0 | 0 | 0 | 0 |
| 4 | 1 | 1 | 1 | 1 | 1 | 1 | 1 | 1 | 1 | 1 | 1 | 1 | 1 | 1 | 1 | 1 | 1 | 1 | 1 |
| 5 | 1 | 1 | 1 | 1 | 1 | 1 | 1 | 1 | 1 | 1 | 1 | 1 | 1 | 1 | 1 | 1 | 1 | 1 | 1 |
| 6 | 0 | 0 | 0 | 0 | 1 | 0 | 1 | 0 | 1 | 0 | 1 | 0 | 1 | 0 | 1 | 0 | 0 | 0 | 1 |
| 7 | 1 | 1 | 1 | 0 | 0 | 0 | 0 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 | 0 | 0 | 0 | 0 | 0 | 0 | 0 |
| 9 | 1 | 1 | 1 | 1 | 1 | 1 | 1 | 1 | 1 | 1 | 1 | 1 | 1 | 1 | 1 | 1 | 0 | 0 | 0 |
| 10 | 1 | 1 | 1 | 1 | 1 | 1 | 1 | 1 | 1 | 1 | 1 | 0 | 0 | 0 | 0 | 0 | 1 | 0 | 1 |
| 11 | 0 | 0 | 0 | 0 | 0 | 0 | 0 | 0 | 0 | 0 | 0 | 0 | 0 | 0 | 0 | 0 | 0 | 0 | 0 |
| 12 | 1 | 1 | 1 | 1 | 1 | 1 | 1 | 1 | 1 | 0 | 0 | 0 | 0 | 1 | 1 | 1 | 0 | 1 | 0 |
| 13 | 1 | 1 | 0 | 0 | 0 | 0 | 0 | 1 | 1 | 0 | 0 | 0 | 0 | 0 | 0 | 0 | 0 | 0 | 0 |
| 14 | 1 | 0 | 1 | 1 | 1 | 0 | 0 | 0 | 0 | 0 | 0 | 0 | 0 | 0 | 0 | 1 | 0 | 0 | 0 |

| key \ i | 19 | 20 | 21 | 22 | 23 | 24 | 25 | 26 | 27 | 28 | 29 | 30 | 31 | 32 | 33 | 34 | 35 | 36 | 37 |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 1 | 0 | 0 | 0 | 0 | 0 | 0 | 0 | 0 | 0 | 0 | 0 | 0 | 0 | 0 | 0 | 0 | 0 | 0 | 0 |
| 2 | 1 | 1 | 1 | 1 | 1 | 1 | 1 | 1 | 1 | 1 | 1 | 1 | 1 | 0 | 1 | 0 | 0 | 0 | 0 |
| 3 | 0 | 0 | 0 | 0 | 0 | 0 | 0 | 0 | 1 | 0 | 0 | 0 | 0 | 0 | 0 | 0 | 0 | 0 | 0 |
| 4 | 1 | 1 | 1 | 1 | 1 | 1 | 1 | 1 | 0 | 0 | 0 | 0 | 0 | 1 | 0 | 1 | 1 | 0 | 1 |
| 5 | 1 | 1 | 1 | 1 | 1 | 0 | 0 | 0 | 0 | 0 | 0 | 0 | 1 | 1 | 0 | 1 | 0 | 0 | 0 |
| 6 | 1 | 0 | 0 | 0 | 1 | 0 | 0 | 0 | 0 | 0 | 0 | 0 | 0 | 0 | 0 | 0 | 0 | 0 | 1 |
| 7 | 0 | 0 | 0 | 0 | 0 | 0 | 0 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 | 0 | 0 | 0 | 0 | 0 | 0 | 0 |
| 9 | 0 | 0 | 0 | 0 | 0 | 1 | 1 | 0 | 0 | 1 | 0 | 0 | 1 | 1 | 0 | 0 | 0 | 0 | 0 |
| 10 | 0 | 1 | 1 | 0 | 0 | 1 | 1 | 0 | 0 | 0 | 1 | 0 | 0 | 0 | 0 | 0 | 0 | 0 | 0 |
| 11 | 0 | 0 | 0 | 0 | 0 | 0 | 0 | 0 | 0 | 0 | 0 | 0 | 0 | 0 | 0 | 0 | 0 | 0 | 0 |
| 12 | 1 | 1 | 1 | 0 | 0 | 0 | 1 | 0 | 0 | 0 | 0 | 1 | 0 | 0 | 0 | 0 | 0 | 0 | 0 |
| 13 | 0 | 0 | 0 | 0 | 0 | 0 | 0 | 0 | 0 | 0 | 0 | 0 | 0 | 0 | 0 | 0 | 0 | 0 | 0 |
| 14 | 0 | 0 | 1 | 0 | 0 | 0 | 0 | 0 | 0 | 0 | 0 | 0 | 0 | 0 | 0 | 0 | 0 | 0 | 0 |

Fig.5

TNK

| i | TN |
|---|---|
| 0 | 0 |
| 1 | 0 |
| 2 | 1 |
| 3 | 1 |
| 4 | 2 |
| 5 | 2 |
| 6 | 3 |
| 7 | 4 |
| 8 | 5 |
| 9 | 5 |
| 10 | 5 |
| 11 | 6 |
| 12 | 6 |
| 13 | 6 |
| 14 | 6 |
| 15 | 6 |
| 16 | 6 |
| 17 | 7 |
| 18 | 8 |
| 19 | 8 |
| 20 | 8 |
| 21 | 8 |
| 22 | 9 |
| 23 | 10 |
| 24 | 10 |
| 25 | 10 |
| 26 | 10 |
| 27 | 10 |
| 28 | 10 |
| 29 | 11 |
| 30 | 11 |
| 31 | 12 |
| 32 | 13 |
| 33 | 13 |
| 34 | 13 |
| 35 | 13 |
| 36 | 13 |
| 37 | 13 |
| 38 | 13 |
| 39 | 13 |
| 40 | 14 |
| 41 | 15 |
| 42 | 15 |
| 43 | 15 |
| 44 | 15 |

| i | TN |
|---|---|
| 45 | 16 |
| 46 | 16 |
| 47 | 16 |
| 48 | 17 |
| 49 | 17 |
| 50 | 17 |
| 51 | 18 |
| 52 | 18 |
| 53 | 19 |
| 54 | 20 |
| 55 | 20 |
| 56 | 20 |
| 57 | 21 |
| 58 | 22 |
| 59 | 22 |
| 60 | 22 |
| 61 | 22 |
| 62 | 23 |
| 63 | 24 |
| 64 | 25 |
| 65 | 25 |
| 66 | 25 |
| 67 | 25 |
| 68 | 25 |
| 69 | 26 |
| 70 | 26 |
| 71 | 26 |
| 72 | 26 |
| 73 | 27 |
| 74 | 27 |
| 75 | 27 |
| 76 | 27 |
| 77 | 27 |
| 78 | 27 |
| 79 | 28 |
| 80 | 28 |
| 81 | 28 |
| 82 | 29 |
| 83 | 29 |
| 84 | 30 |
| 85 | 30 |
| 86 | 30 |
| 87 | 31 |

Fig.6

TNS

| i | TN | TN |
|---|---|---|
| 0 | 0 | -2 |
| 1 | 0 | -2 |
| 2 | 1 | -1 |
| 3 | 2 | 0 |
| 4 | 3 | 1 |
| 5 | 4 | 2 |
| 6 | 4 | 2 |
| 7 | 5 | 3 |
| 8 | 5 | 3 |
| 9 | 6 | 4 |
| 10 | 6 | 4 |
| 11 | 7 | 5 |
| 12 | 7 | 5 |
| 13 | 7 | 5 |
| 14 | 7 | 5 |
| 15 | 7 | 5 |
| 16 | 8 | 6 |
| 17 | 8 | 6 |
| 18 | 8 | 6 |
| 19 | 8 | 6 |
| 20 | 8 | 6 |
| 21 | 8 | 6 |
| 22 | 9 | 7 |
| 23 | 10 | 8 |
| 24 | 10 | 8 |
| 25 | 10 | 8 |
| 26 | 11 | 9 |
| 27 | 12 | 10 |
| 28 | 12 | 10 |
| 29 | 12 | 10 |
| 30 | 12 | 10 |
| 31 | 12 | 10 |
| 32 | 12 | 10 |
| 33 | 13 | 11 |
| 34 | 13 | 11 |
| 35 | 14 | 12 |
| 36 | 15 | 13 |
| 37 | 15 | 13 |

Fig.7(A)
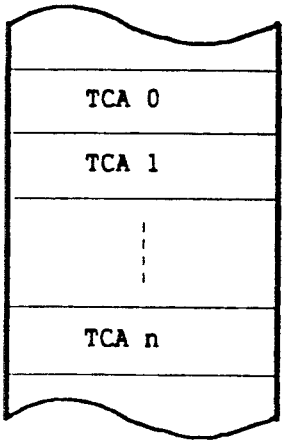
Fig.7(B)
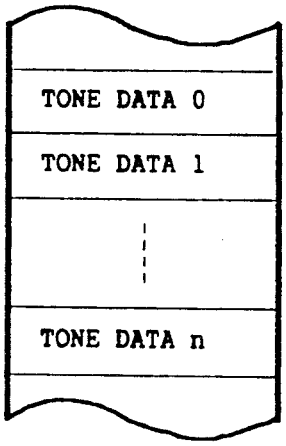
Fig.7(C)
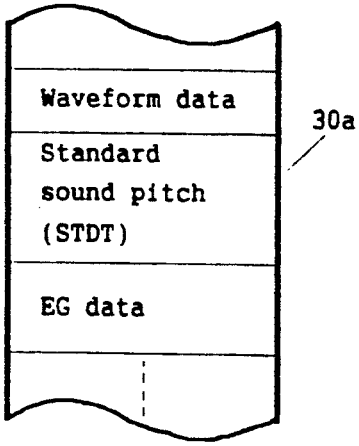
Fig.8
| Tone color | Tonality | STDT |
|---|---|---|
| Soprano saxophone | Bflat3 | 58 |
| Alto saxophone | Eflat3 | 51 |
| Tenor saxophone | Bflat2 | 46 |
| Baritone saxophone | Eflat2 | 39 |
| Bass saxophone | Bflat1 | 34 |
| Trombone | Bflat2 | 45 |
| Oboe | Cflat4 | 60 |
| Trumpet | Bflat2 | 46 |
| Clarinetto | Eflat4 | 63 |
| Clarinetto | Bflat3 | 58 |
| Flute | C4 | 60 |
| Sopranino recorder | F5 | 77 |
| Soprano recorder | C5 | 72 |
| Alto recorder | F4 | 65 |
| Tenor recorder | C4 | 60 |
| Piccolo | C6 | 84 |
| Euphorium | F3 | 53 |
| Accordion | C3 | 48 |
| Contrabass | C2 | 36 |
| Guitar | C3 | 48 |

Fig.9

| CN | 0 | 1 | 2 | 3 | 4 | 5 | 6 | 7 | 8 | 9 | 10 | 11 |
|---|---|---|---|---|---|---|---|---|---|---|---|---|
| Pitch name | C | Db | D | Eb | E | F | Gb | G | Ab | A | Bb | B |
| Value | 12 | 13 | 13 | 14 | 14 | 15 | 9 | 9 | 10 | 10 | 11 | 11 |
| Decimal point | OFF | ON | OFF | ON | OFF | OFF | ON | OFF | ON | OFF | ON | OFF |
| An example of indication | C | d. | d | E. | E | F | 9. | 9 | A. | A | b. | b |

Fig.10

| | |
|---|---|
| BD | Breath intensity buffer |
| BS | Breath threshold |
| BUF | Key pattern buffer |
| BUFA | Key pattern buffer for processing |
| BUFB | Octave key buffer |
| CHG | Fingering pattern change flag |
| CN | Code name buffer |
| DH | High-order indication buffer |
| DL | Low-order indication buffer |
| DPMD | Indication mode flag |
| FNGMD | Fingering mode flag |
| i | Table pointer |
| KCD | Key code register |
| KON | Key ON flag |
| OLD | Former pattern buffer |
| PN | Key pattern total number register |
| PP | Key pattern top address register |
| PT | Key pattern buffer for comparison |
| STDT | Standard sound pitch register |
| TC | Tone color number register |
| TN | Tone number buffer |
| TNT | Tone number table buffer |

ELECTRONIC MUSICAL INSTRUMENT WITH SELECTION OF STANDARD SOUND PITCH OF A NATURAL INSTRUMENT UPON SELECTION OF TONE COLOR

BACKGROUND OF THE INVENTION

1. Field of the Invention

This invention relates to an electronic musical instrument. especially a simulating wind instrument, capable of setting a standard sound pitch.

2. Description of the Prior Art

At present various electronic musical instruments such as electronic organs and synthesizers are available. In addition to the popular keyboard type electronic musical instruments, the electronic wind instruments are also available. Because the electronic wind instruments insure easy melody play (single tone play), easy playing posture and easy carrying as well as easy expression such as crescendo and decrescendo with breath sensor (a sensor detecting the blowing-in breath intensity), they are finding ever increasing applications.

Since these electronic musical instruments are mainly used as extension of the natural wind instruments and recorders (end-blown flutes) which are used as teaching aids at primary and junior high schools in Japan, their key arrangement and fingering are similar to those of the above-mentioned natural wind instruments (including the recorders). An example of recorder fingering is provided hereafter. Thus, all the holes of a recorder must be closed to give a "do", the lowest pitch sound. As the player's fingers are released from the recorder holes successively, beginning with the little finger of the right hand, a major scale playing is given. Semitones, tones other than scale tones, can be given by combining the closed holes and opened holes. Thus, the recorder is designed as a musical instrument based on the major scale, the lowest pitch sound of which is "do". Here, the standard sound pitch of the recorder is the sound pitch "C5 (soprano)" and "F5 (alto) of this lowest pitch sound "do(c)". Thus, the lowest pitch sounds of wind instruments are generally assumed to be the standard sound pitch of the pertinent wind instruments.

Nevertheless, the standard sound pitch of natural musical instruments differs depending on the type of musical instruments. Some musical instruments, such as saxophones and clarinets, which belong to the same category of musical instruments, differ in the standard sound pitch. Although the octave differs, the standard sound pitches of conventional electronic musical instruments are all set to "C". Accordingly, even when the tone color is changed, the standard sound pitch of the musical instrument which has this tone color is not changed.

As a result of this, when the player of a natural musical instrument changes his instrument from the natural musical instrument to such an electronic musical instrument, he feels difficulty in playing the electronic musical instrument because of different fingering. Moreover, when he plays a transposing instrument (musical instrument whose real playing sound differs from notes, such as clarinet, trumpet, etc.), he must play, intentionally transposing, which makes playing difficult, using the original notes. The same is true for the keyboard type electronic musical instruments.

SUMMARY OF THE INVENTION

In brief, an object of this invention is to provide an electronic musical instrument which makes it easy to play by automatically matching the electronic musical instrument to the standard sound pitch of a natural musical instrument when any tone color resembling the tone color of a natural musical instrument is selected. Accordingly, this invention makes it possible to decide on the standard sound pitch, synchronizing with selection of a specific tone color, so that the electronic musical instrument can be played at the same standard sound pitch as that of a natural musical instrument. If this invention is applied to a wind electronic instrument, it can be played by the same fingering as that used for the natural musical instrument; which insures easy change from the natural musical instrument to the electronic musical instrument. Even when playing music using a note for transposing instruments, there is no need to rewrite the note or to transpose to the original tone, thereby simplifying playing.

BRIEF DESCRIPTION OF THE DRAWINGS

FIG. 1 (C) is a magnified view of an indicator of this electronic musical instrument.

FIG. 3(A) and 3(B) and FIG. 4 are key pattern tables set in a fingering data ROM of this control section.

FIG. 5 and FIG. 6 are key pattern tables set in this ROM.

FIG. 7 (A), FIG. 7 (B) and FIG. 7 (C) are tone color address tables and a tone color memory map set in a tone color data ROM.

FIG. 8 is a diagram for explaining a tonality of a natural musical instrument.

FIG. 9 is a code name table set in a data ROM of the control section.

FIG. 10 is a list of data areas of the data ROM and RAM of the control section.

DESCRIPTION OF THE PREFERRED EMBODIMENTS

Figure 1A:
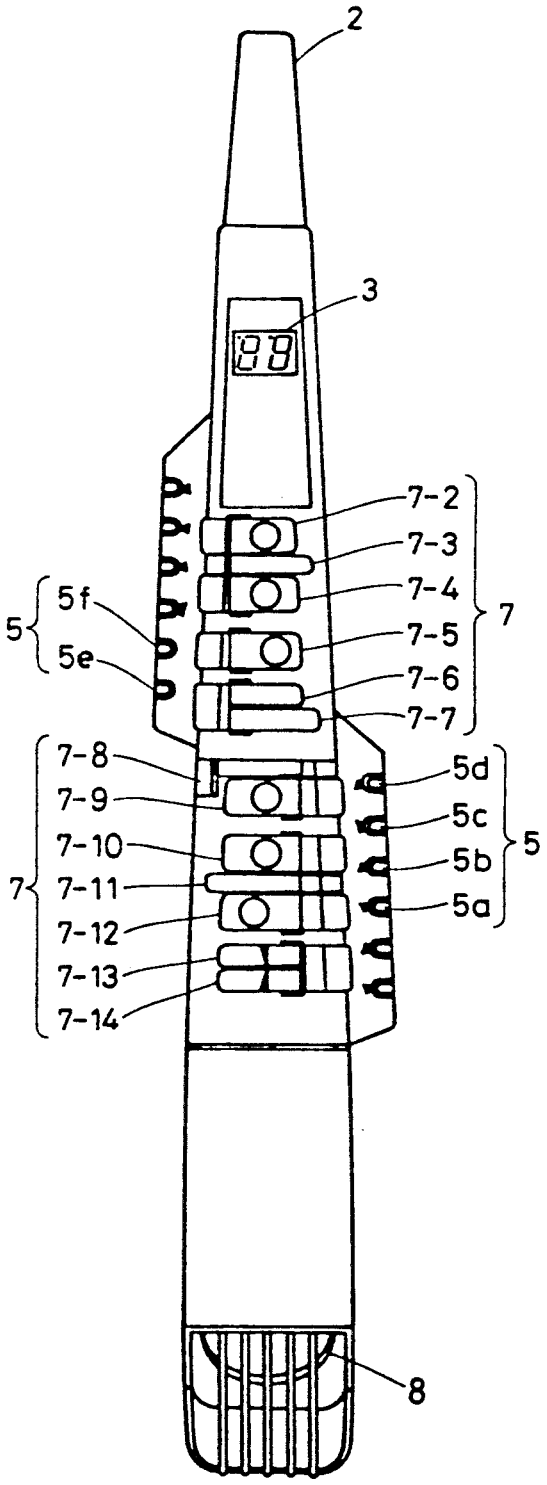
FIG. 1(A) and FIG. 1 (B) show an appearance of an electronic musical instrument which is an embodiment of this invention.
Figure 1B:
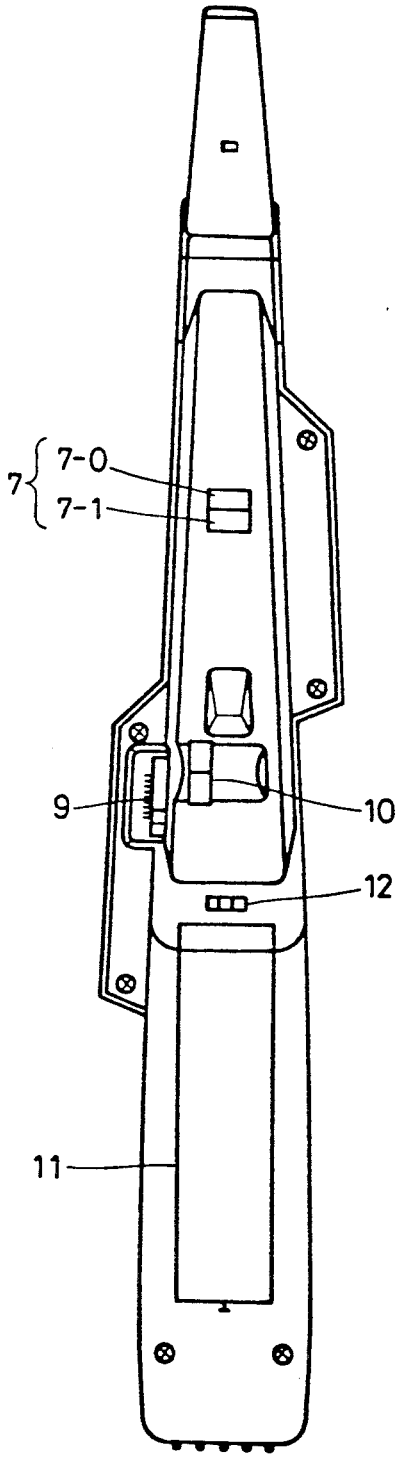
Figure 1C:
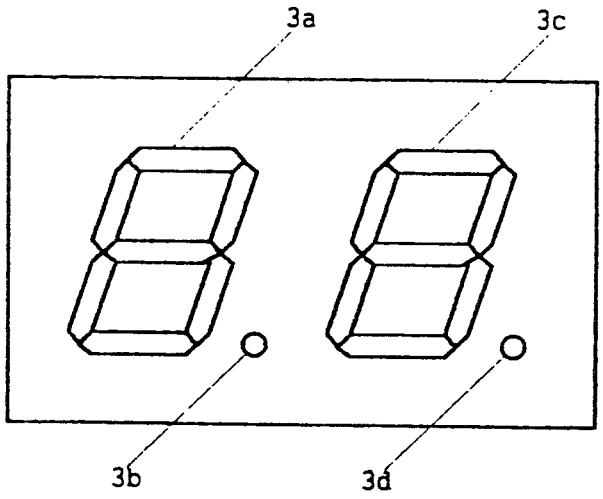

FIG. 1 (A) and FIG. 1(C) show an appearance of an electronic musical instrument which is an example of an embodiment of this invention. FIG. 1 (D) shows a configuration of an indicator of the electronic musical instrument. This electronic musical instrument can generate several tone colors, one of which can be selected with the aid of a switch. When a specific tone color is selected, a standard sound pitch matching this tone color is set. Generally, it is set to the same standard sound pitch as that of the natural musical instrument. A player can select either a recorder like fingering (recorder mode) or a saxophone-like fingering (saxophone mode) to specify a fingering which decides the sound pitch. The sound pitch is specified according to the specified fingering, and a threshold quantity of breath or more is blown to emit a musical tone from this electronic musical instrument.

This musical instrument has a shape resembling a woodwind instrument and has a mouthpiece 2 at its front end. The player attaches this mouthpiece 2 to his lip and blows in breaths to play. A breath sensor 21 is provided inside the mouthpiece 2. It detects the intensity of blown in breath (breath intensity) and sends the detected data to a CPU. An indicator 3, mode selection switches 5 and playing keys are provided outside the instrument. As shown in FIG. 1 (C) the indicator 3 is a 2-digit 7-segment display. Each digit, namely 3*a* and 3*c*, has a decimal point indicator, 3*b* and 3*d*. Each of them can light and go out individually. This indicator indicates a number of selected tone colors (tone color number) and a selected standard sound pitch. The mode selection switches 5 provided at a side of the musical instrument are used to specify an operation mode to this musical instrument. The provided selection switches are a standard sound pitch increment switch 5*a*, a standard sound pitch decrement switch 5*b*, a tone color number increment switch 5*c*, a sound pitch decrement switch 5*d*, an indication selection switch 5*e*, and a fingering mode selection switch 5*f*. The standard sound pitch increment switch 5*a* and the standard sound pitch decrement switch 5*b* are used to raise and lower the preset standard sound pitch by semitone, respectively. The tone color number increment switch 5*c* and the tone color number decrement switch 5*d* are used to change upward or downward, following the order shown in a sound tone list 11 provided at a rear side of the musical instrument (FIG. 1 (C)). The fingering mode selection switch 5*f* is used to change the fingering mode to the recorder mode or to the saxophone mode. The indication selection switch 5*e* is used to change the display of the indicator 3 to the currently specified tone color number or standard sound pitch. The playing keys 7 (7-0 to 7-14) are provided at the center of the rear side and the front side of musical instrument. The keys 7-0 to 7-7 are operated by the left-hand fingers whereas the keys 7-8 to 7-14 are operated by the right-hand fingers. One sound pitch is specified by setting a combination of ON/OFF of these keys to one of the patterns of the recorder mode or saxophone mode (FIG. 3 or FIG. 4). A speaker 8 is provided at the lower part of the musical instrument. From the speaker the playing musical tone is outputted. A main volume 9, a pitch bend wheel 10 and a power switch 12 are provided at the rear side of the musical instrument. Sound volume of the musical instrument can be controlled by sliding up or down the main volume 9 (sound volume can be controlled also with a breath sensor). Pitch (frequency) of the musical tone can be raised or lowered by rotating up or down the pitch bend wheel 10. The above-mentioned tone color list 11 serves also as a lid of a battery case.

Figure 2:
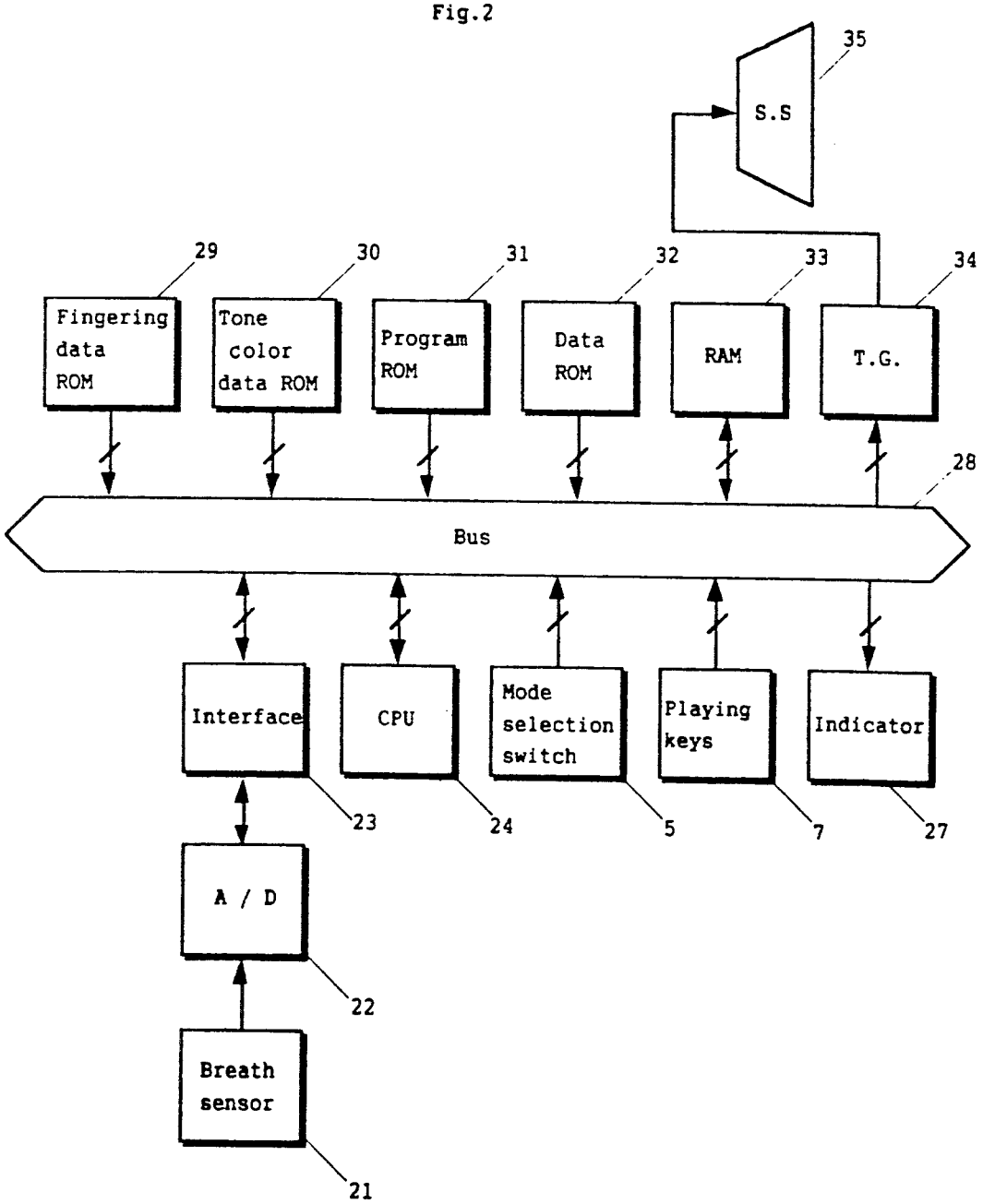
FIG. 2 is a block diagram of a control section of this electronic musical instrument.
Figure 11A:
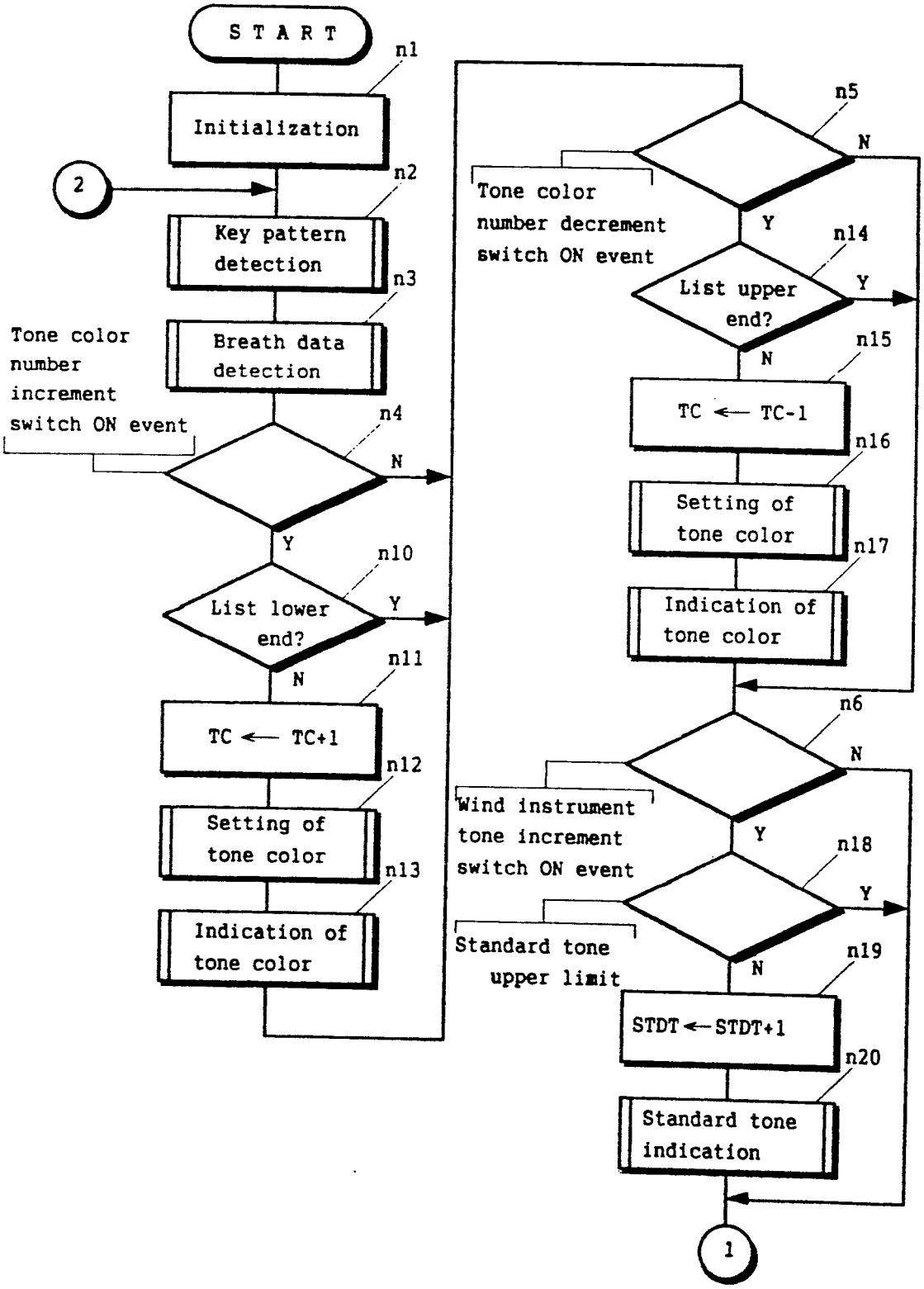
FIG. 11 (A) to (J) are flow charts indicating the operation of the control section.
Figure 11B:
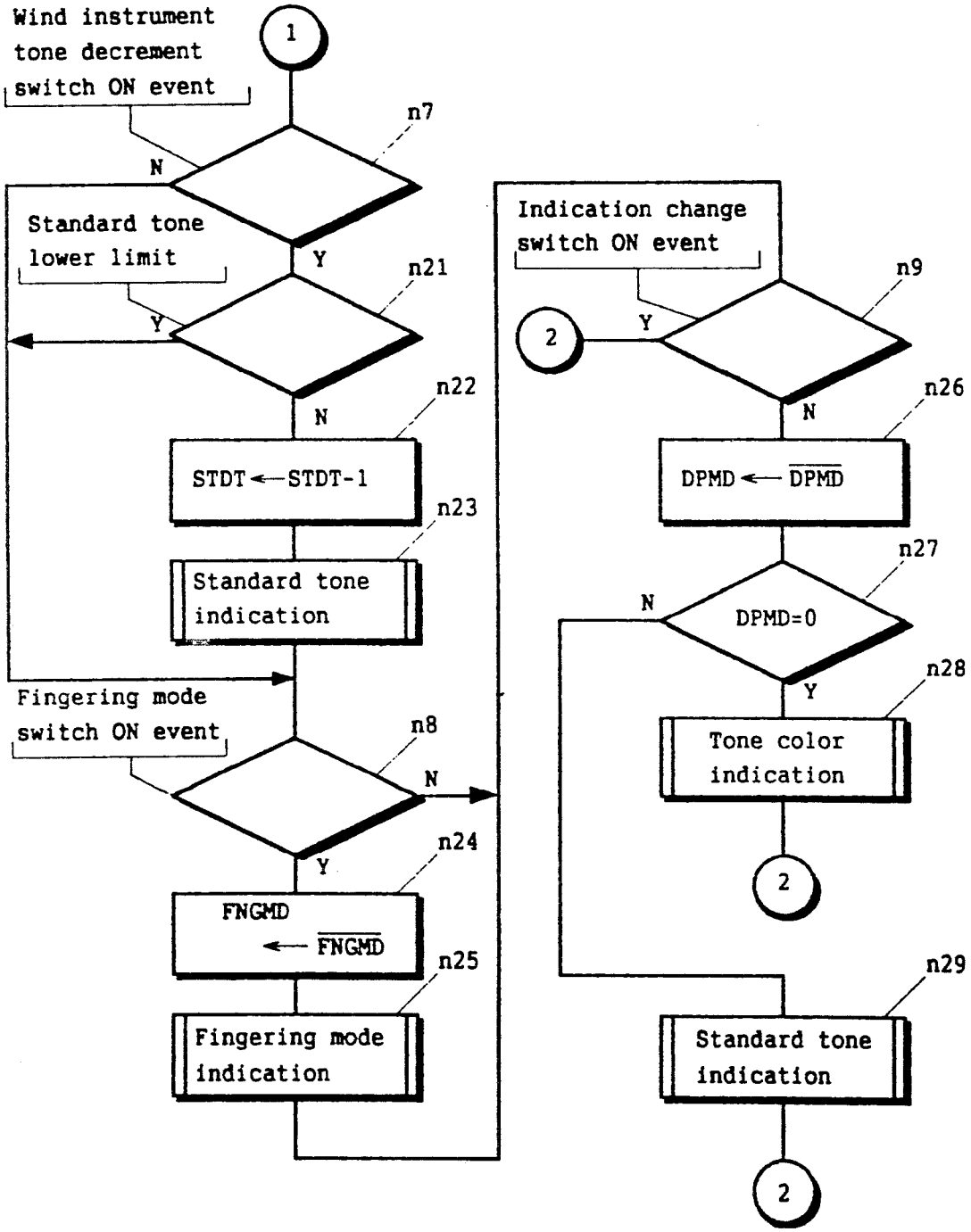
Figure 11C:
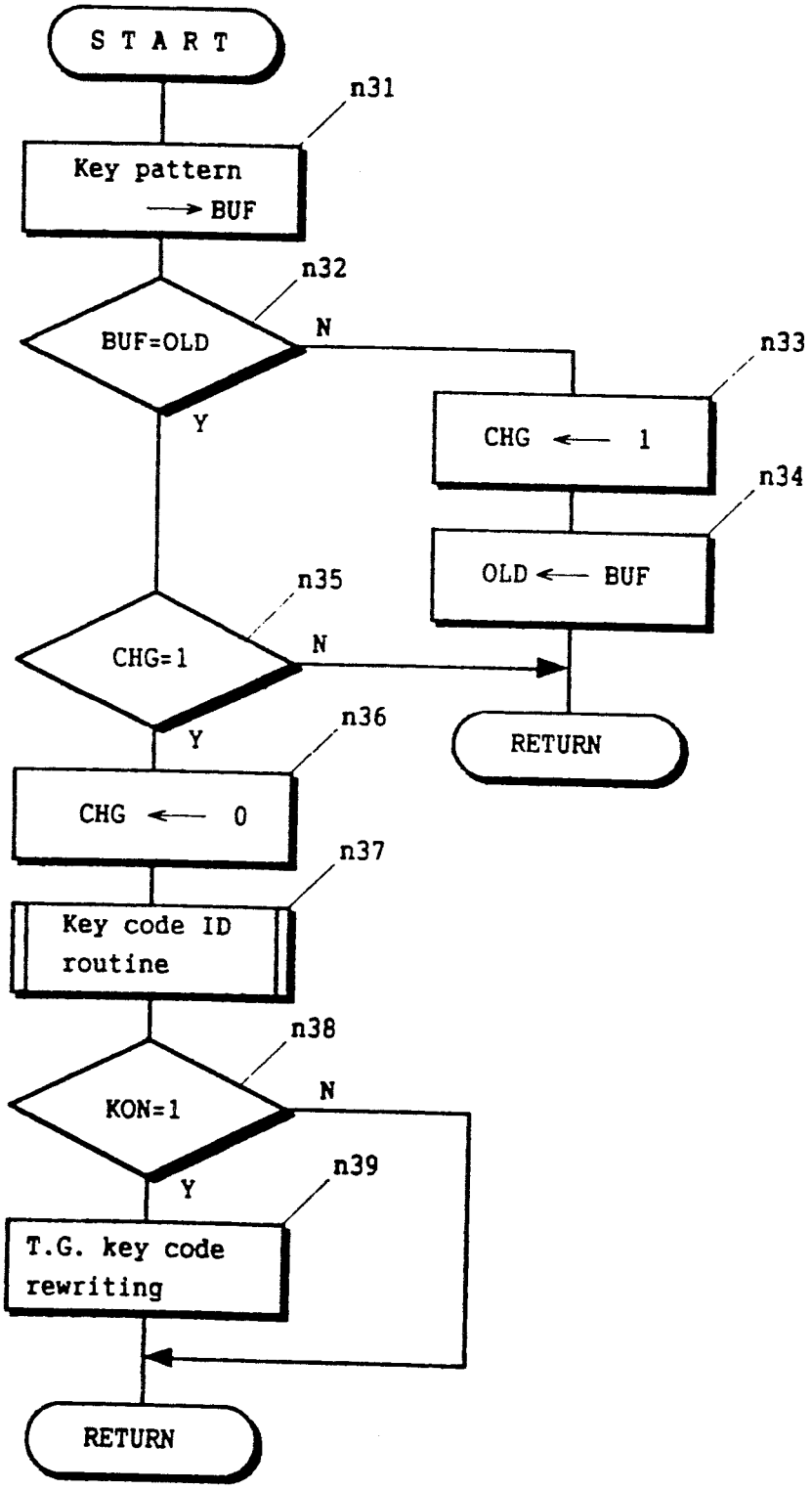
Figure 11D:
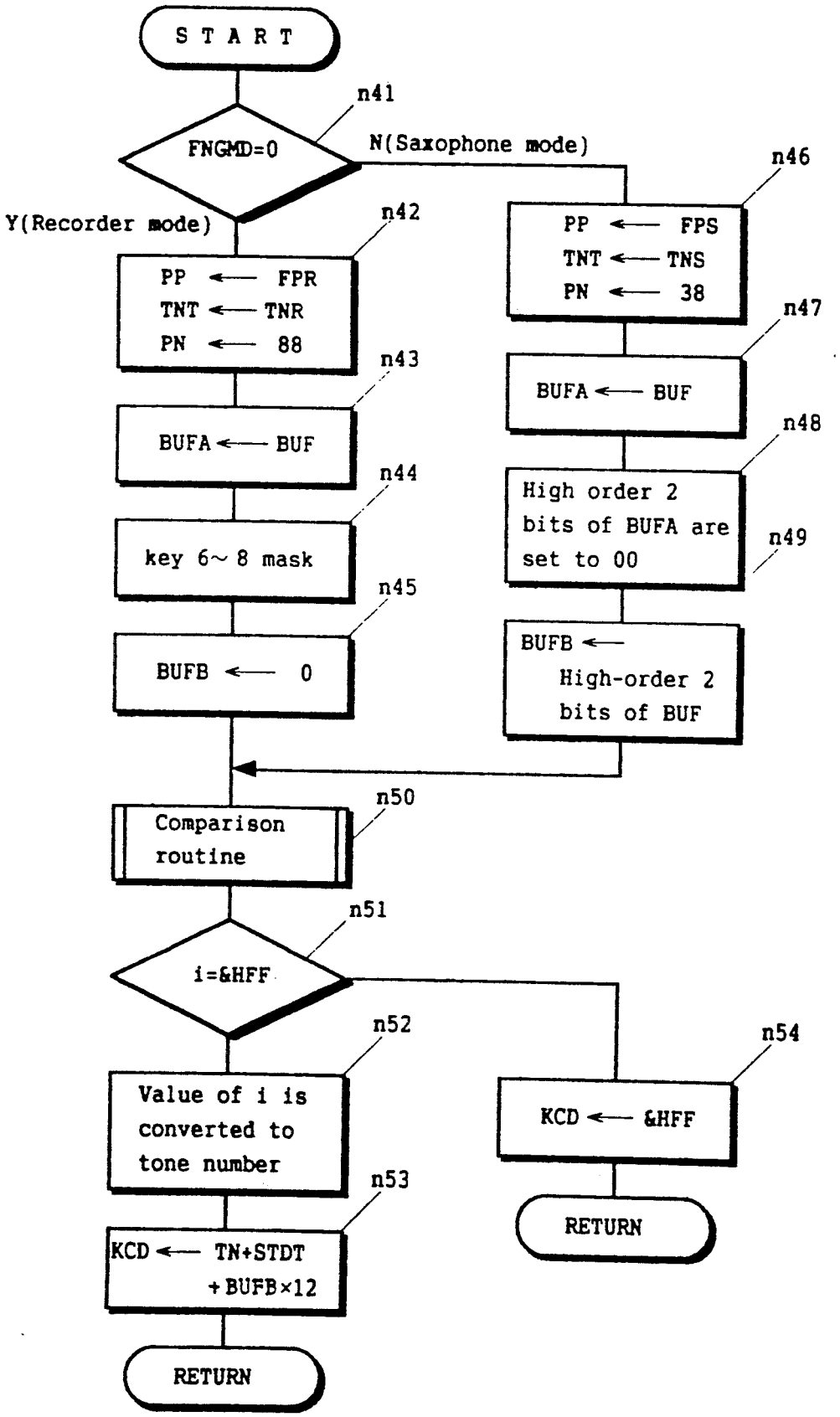
Figure 11E:
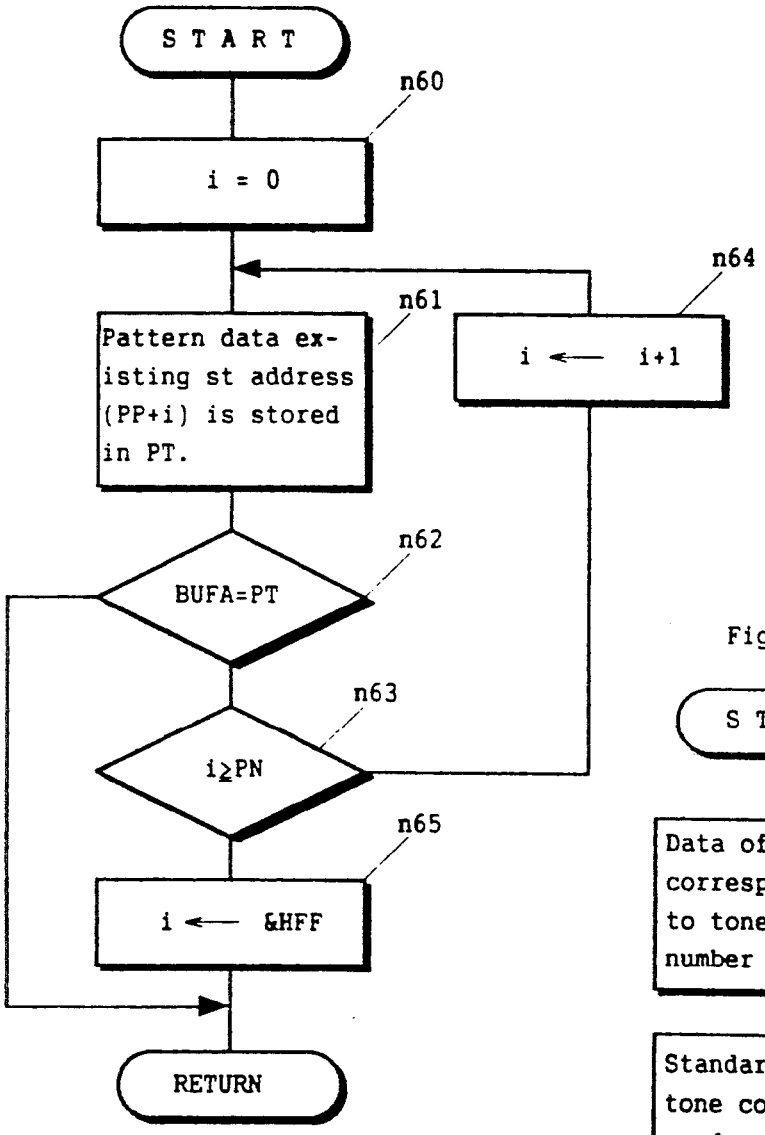
Figure 11F:
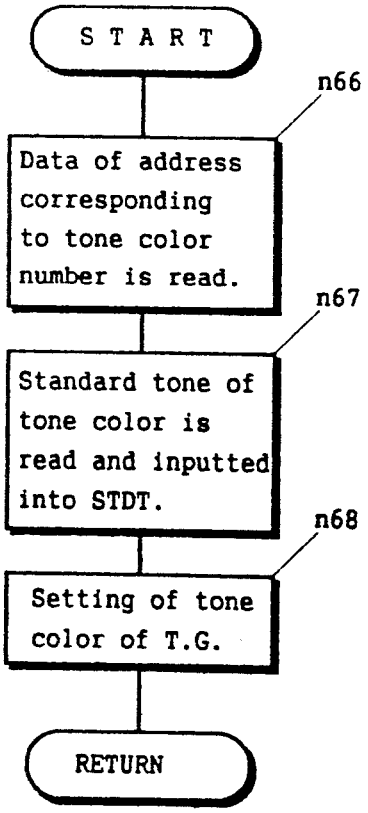
Figure 11G:
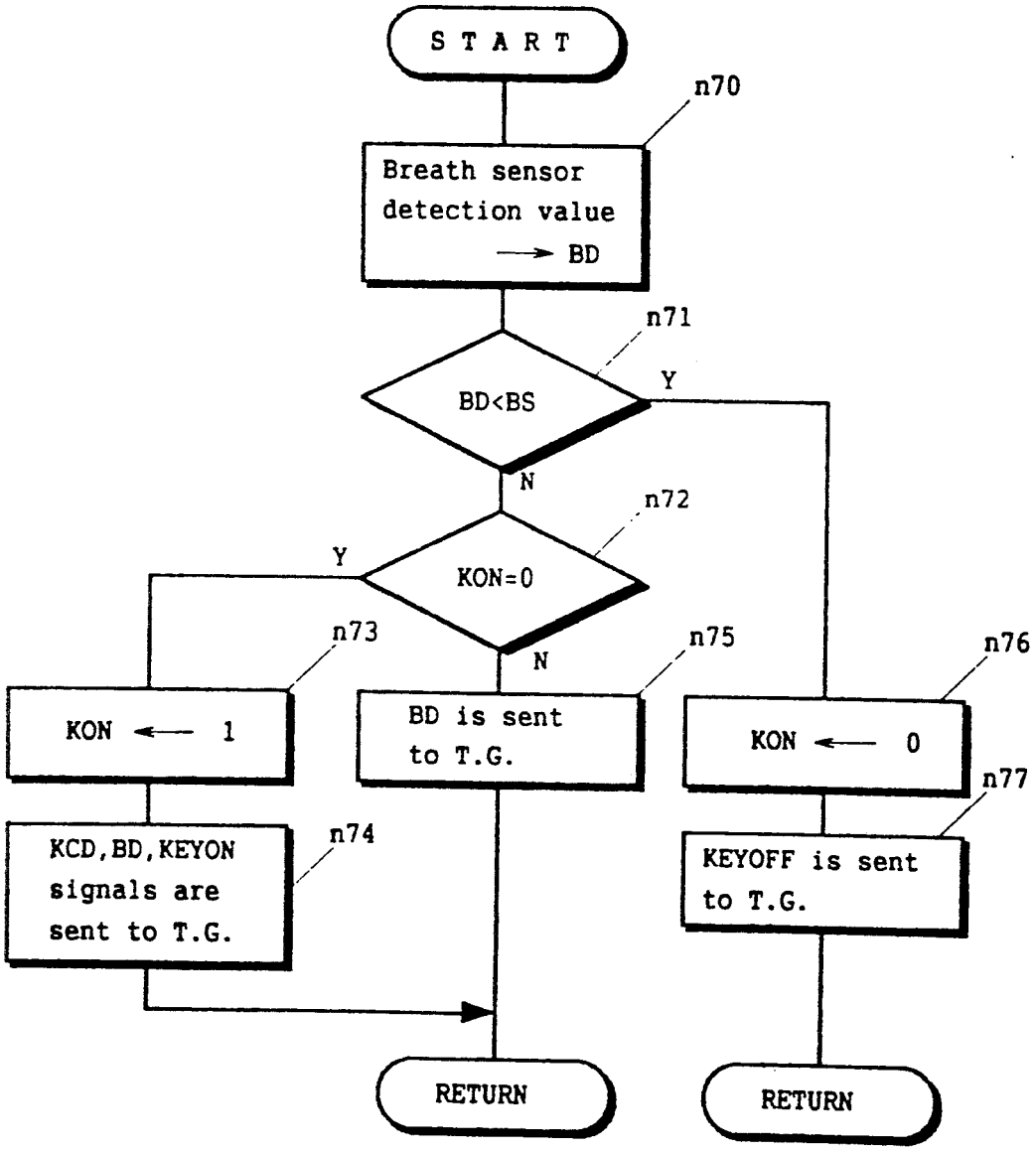
Figure 11H:
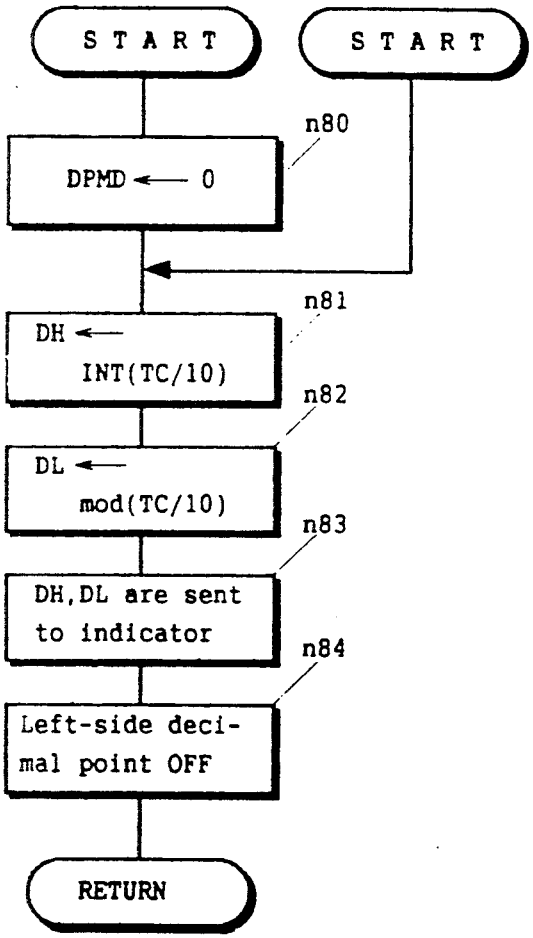
Figure 11I:
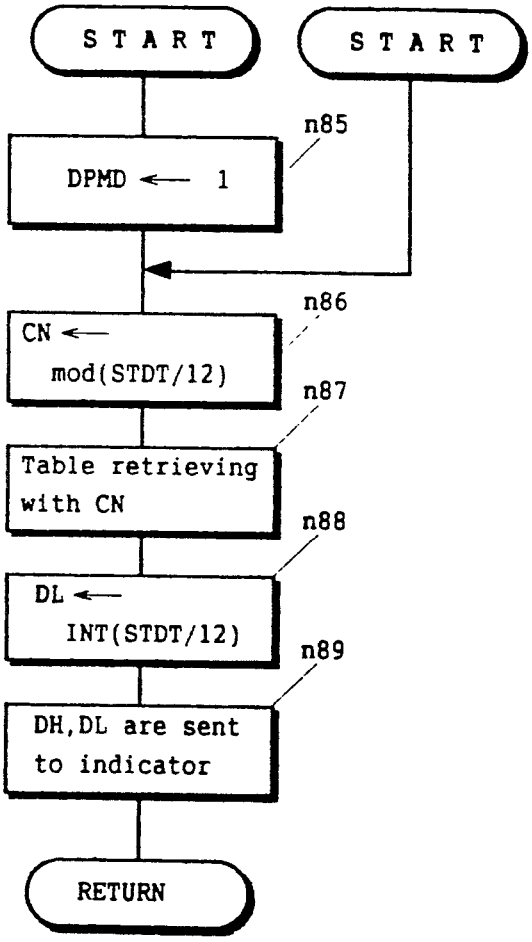
Figure 11J:
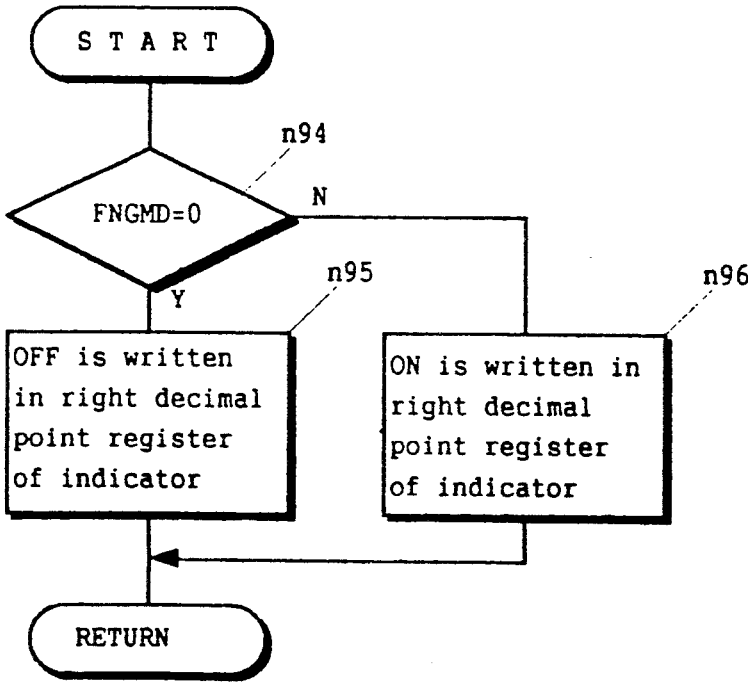
Figure 12:
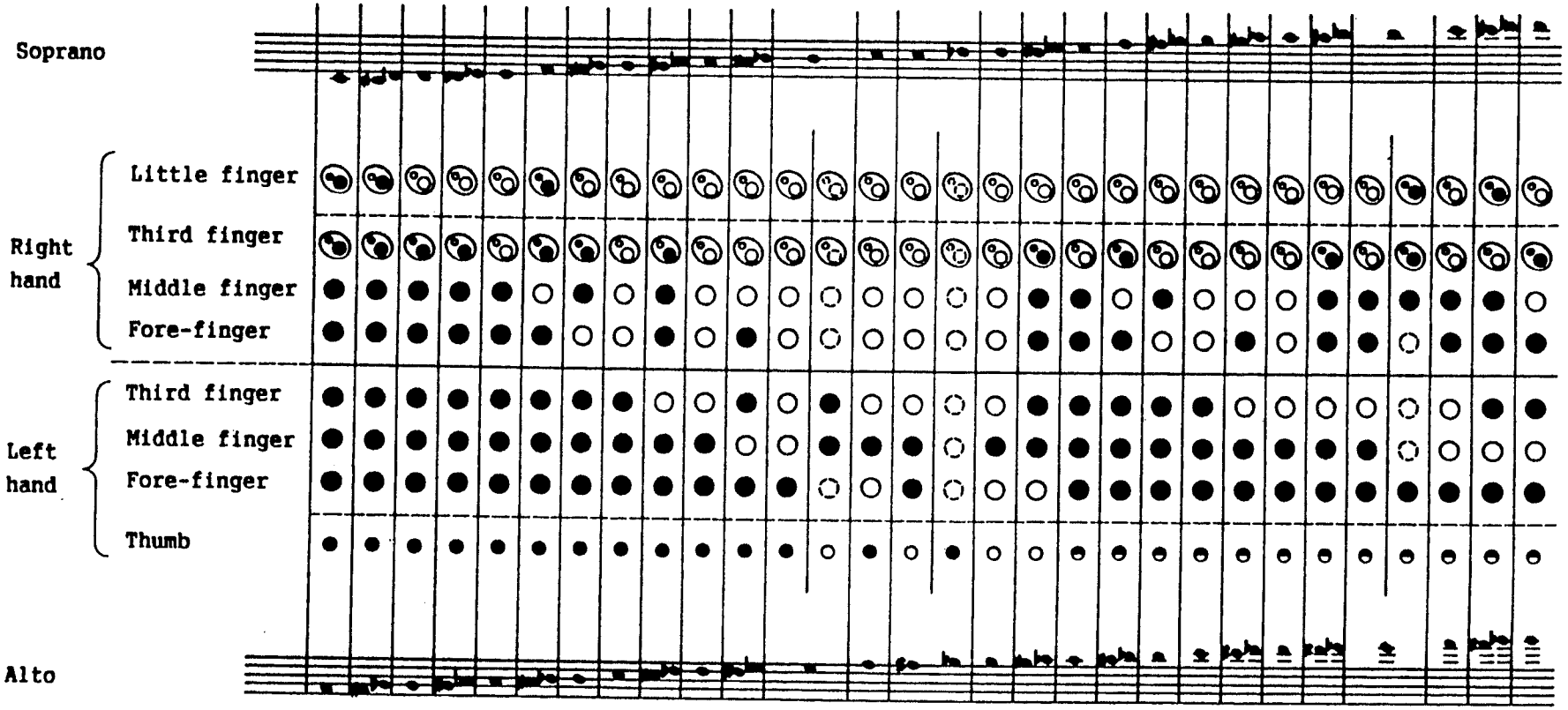
FIG. 12 shows a fingering of an ordinary recorder.

To play this musical instrument, the player turns on the power switch 12 (at this time it is preset to a specific tone color and a standard sound pitch). Operating the standard sound pitch increment switch 5*a*, the standard sound pitch decrement switch 5*b*, the tone color number increment switch 5*c*, the tone color number decrement switch 5*d*, and the fingering mode selection switch 5*f*, the player sets a required tone color, standard sound pitch and fingering mode. Then by blowing in breath into the mouthpiece 2, he plays the musical instrument with the aid of the playing keys 7. The current set mode can be ascertained by using the indication selection switch 5*e*. FIG. 2 is a block diagram of the electronic musical instrument. A CPU 24 and each operating section are connected through a bus 28. The breath sensor 21 is connected to the bus 28 through an A/D converter 22 and an interface 23. The breath intensity detected by the breath sensor 21 is converted to digital data by the A/D converter 22 and sent to the CPU 24 through the interface 23 and the bus 28. Memories, namely a fingering data ROM29, a tone color data ROM30, a program ROM31, a data ROM32 and a RAM33 are connected to the bus 23. The fingering pattern table (FIG. 3, FIG. 4) for pertinent fingering mode and the tone number table (FIG. 5, FIG. 6) are stored in the fingering data ROM29. The tone color data (waveform data, standard sound pitch data, etc.; FIG. 8) for the pertinent tone color are stored in the tone color data ROM30. The program and data for operation of the electronic musical instrument are stored in the program ROM31 and the data ROM32, respectively. The RAM33 has an area (see FIG. 10) to store temporarily the set mode data and fingering pattern data. The mode selection switches 5, the playing keys 7, the indicator section 27, and a sound source (tone generator) 34 are connected to the bus 28. Each mode selection switch and each playing key are periodically scanned by the CPU 24 to check ON/OFF. The indicator section 27 has the indicator 3 and a hexadecimal (0 to F) segment driver. The sound source 34 generates musical tone based on the tone color data inputted from the CPU24 and determines the sound volume (envelope) based on the breath intensity (inputted from the CPU24) detected by the breath sensor 21. A sound system 35 is connected to the sound source 34. The generated musical tone is amplified and outputted from the speaker 8.

FIG. 3, FIG. 4, FIG. 5, and FIG. 6 show a fingering pattern table (FIG. 3, FIG. 4) and a tone number table (FIG. 5, FIG. 6) stored in the fingering data ROM29.

FIG. 3 shows a fingering pattern of the recorder mode whereas FIG. 4 shows a fingering pattern in the saxophone mode. The recorder mode has 88 types of fingering patterns, from pattern number $i=0$ to 87. Among them, the pattern of $i=0$, 1 is the fingering pattern specifying the standard sound pitch. In the recorder mode the keys 7-6 to 7-8 are not used. Therefore in case of the fingering pattern the check bits corresponding to these keys are masked. In the saxophone mode the 38 fingering patterns, from $i=0$ to 37, are set. In the case of saxophone mode the fingering pattern of "do(c)" differs from that of the recorder mode. Namely, the fingering pattern of $i=3$ specifies the standard sound pitch. In the saxophone mode the keys 7-0 and 7-1 provided at the rear side of the musical instrument are used as octave keys but not used for specifying the tone name.

FIG. 5 and FIG. 6 show a tone number table. The scale tone number (number given to each semitone, assuming that low tone "do" to be "0") corresponding to the pertinent fingering pattern of above-mentioned fingering pattern table is stored in the memory. FIG. 5 corresponds to the recorder mode. The fingering patterns of $i=0$ to 87 are assigned to 2.5 octave tones of $TN=0$ to 31. FIG. 6 corresponds to the saxophone mode. The fingering patterns of $i=0$ to 37 are assigned to 1 octave+4 degree tone of $TN=0$ to 15 or $TN=-2$ to 13. In this table both of TN data ($TN=0$ to 15, $TN=-2$ to 13) are available for specifying the pitch. The TN data, $TN=-2$ to 13 is more similar to the fingering of the saxophone. In the saxophone mode the tones of 1st, 2nd and 3rd octave can be given by the same fingering with the aid of octave keys 7-0 and 7-1. The keys 7-7 and 7-13 are so-called low B keys. Sound lower than the standard sound pitch can be given by turning on these keys. The scale tone number deduced from these tables is added to the standard tone number (STDT), and the tone generation tone number is calculated.

FIG. 7 (A), (B) and (C) show a memory map of tone color data ROM30. This ROM stores data of several tone colors. FIG. 7 (A) is a tone color address table where the top address of each tone color memory is stored. This table is referenced based on the tone color number selected by the player. FIG. 7 (B) shows a tone color memory which stores data of each tone color. Each tone color memory starts from the address stored in the address table. Waveform data of pertinent tone color, standard sound pitch (30*a*) and EG data are stored in the pertinent tone color memory as shown in FIG. 7 (C). When this tone color is set, this data is set in the sound source 34, etc. FIG. 8 shows a standard sound pitch (STDT) of each tone color and a standard sound pitch (tonality) of a natural musical instrument. In this figure STDT is expressed by tone number, and the tonality is expressed by pitch name and octave. The standard sound pitch of tenor saxophone is "46", namely "Bflat 2". In this case CPU 24 converts the data of 46 into pitch name and octave B.2 and outputs to an indicator 3.

FIG. 9 shows a code name table which is used to indicate the standard sound pitch, using the indicator 3. This code name table is stored in the data ROM32. In this case the standard sound pitch is expressed not by sound pitch number but by standard sound pitch name (A to G) and the octave which it belongs to. The pitch name of A to G is indicated at the high-order digit of the 7-segment indicator 3, and a decimal point of this order is used as "flat". The low-order digit is used for expressing the octave. The 7-segment driver of indicator section 27 can display hexadecimal numeric (0 to F). Tone name is expressed by using hexadecimal numeric, from 9 to F (since a numeric "9" resembles a lower-case character "g", it is used in place of "G"). A residue obtained when the standard sound pitch STDT is divided by 12 is a numeric CN representing the tone name (tonality) of the pertinent musical instrument. If this CN is 0, the tone name is C. Tone names following C are D_flat, D . . . B.

The value (9 to F) to be displayed and ON/OFF data of a decimal point (indicates flat or natural) can be detected by retrieving the code name table with the aid of CN.

FIG. 10 is a list of storage areas which are set in data ROM32 and RAM33. Below is given an explanation of the data to be stored in the pertinent storage area.

BD — breath intensity buffer: RAM area for taking in detected data of breath sensor 21

BS — breath threshold: ROM area for storing the breath intensity data which express a boundary value of ON/OFF during playing BUF — key pattern buffer: RAM area for buffering the fingering pattern read by CPU 24 from the playing keys 7

BUFA — processing key pattern buffer: RAM area for detecting the code name (tone name)

BUFB — octave key buffer: RAM area for storing the operation state of octave key in saxophone mode CHG — fingering pattern change flag: Flag which is set when the fingering pattern is changed CN — code name buffer: RAM area for storing the detected code name DH, DL — high order indication buffer, low-order indication buffer: RAM area for tentatively storing indication data of indicator 3

DPMD — display mode flag: Flag indicating either tone color indication mode in RESET state or tonality indication mode in SET state FNGMD — fingering mode flag: Flag indicating either saxophone mode in SET state or recorder mode in RESET state i — table pointer: Pointer indicating which column of key pattern table is retrieved KCD — key code register: RAM area for storing the key code found by key pattern detecting operation KON — key ON flag: Flag which is set when breath intensity exceeds the specific intensity (breath threshold BS) during playing OLD — old key pattern buffer: RAM area for storing the key pattern detected by preceding key pattern detecting operation PN — key pattern total number register: RAM area for storing the key patter total number of the selected fingering mode PP — key pattern top address register: RAM area for storing the top address of key pattern table of the selected fingering mode PT — comparison key pattern buffer: RAM area for tentatively storing the key pattern read from the key pattern table to compare it with the content of BUFA STDT — standard sound pitch register: RAM area for storing the set standard sound pitch TC — tone color number register: RAM area for storing the selected tone color number TN — tone number buffer: RAM area for tentatively storing the scale tone number found from the tone number table TNT — tone number table buffer: RAM area for storing read tone number table of the selected fingering mode FIG. 11 is a flow chart showing the operation of an electronic musical instrument. FIG. 11 (A),(B) shows a main routine. FIG. 11 (C) to (J) show subroutines.

In FIG. 11 (A),(B) when the power supply is turned on, initialization is performed at first. As a result of this initialization the memories are cleared, and previously specified data are preset herein. For example, the tone color of a clarinet and the standard sound pitch of 58 (Bflat ), and fingering mode of a saxophone are preset. Upon completion of initialization an operation status detecting routine, step n2 and on, is repeated. While this operation status detecting routine is performed, the operation status such as settings of playing keys and mode selection switches are detected. At the steps n2 and n3 the key pattern and breath data are detected (details are shown in FIG. 11 (C) to (F)). The key pattern detection is an operation to detect a combination of ON/OFF of playing keys 7-0 to 7-14 and to detect to which sound pitch it corresponds. The breath data detection operation is an operation to control ON/OFF and sound volume by detecting the intensity of breath. As a result of operations of steps n2 and n3 the informations of performance are detected. The operations of step n4 and on are operations for detecting the operation status of the mode setting key.

At the steps n4 to n9 the depression of the mode setting key is detected. At the steps n4 and n5 a judgment as to whether or not depression (ON event) of the tone color number increment switch 5*c* and the tone color number decrement switch 5*d* is performed is executed. At the n6 steps and n7 a judgment as to whether or not depression (ON event) of standard sound pitch increment switch 5*a*, standard sound pitch decrement switch 5*b* is performed is executed. At the step n8 a judgment as to whether or not depression (ON event) of display selection switch 5*e* is performed is executed.

When the tone color number increment switch 5*c* is depressed, the process proceeds from the step n4 to the step n10, and a judgment as to whether or not the process reached the lower end (upper limit of number) of the list is executed. If the process reaches the lower end of the list, the process returns to the main routine. Unless the process reached the lower end of the list, "1" is added to a tone color number buffer TC (n11), and a tone color setting operation (FIG. 11 (G)) is performed (n12). After setting the number of set tone color is indicated on the indicator 3 (FIG. 11 (H): n13), and the process returns to the main routine. When the tone color number decrement switch 5*d* is depressed, the process proceeds from the step n5 to the step n14, and a judgment as to whether or not the process reached the upper end of the list is executed. If the process reached the upper end of the list, the process returns to the main routine, "1" is subtracted from TC (n15), and tone color setting operation is executed (n16). After tone color setting the number of set tone color is indicated on the indicator 3 (n17), and the process returns to the main routine.

The standard sound pitch is set automatically based on the selection of sound pitch as mentioned above. Moreover, the player can raise or lower it at his discretion. This change is possible with an interval of semitone. When the standard sound pitch increment switch 5*a* is pressed, the process proceeds from the step n6 to the step n18, and whether or not the standard sound pitch reached the upper limit is judged. If it reached the upper limit, the process returns to the main routine. If it did not reach the upper limit, "1" is added to the standard sound pitch buffer SWTDT (n19), the standard sound pitch is indicated on the indicator 3 (FIG. 11 (I): n20), and the process returns to the main routine. When the standard sound pitch decrement switch 5*b* is pressed, the process proceeds from the step n7 to the step n21, and a judgment as to whether or not the reference standard sound pitch reached the lower limit is executed. If it reached the lower limit, the process returns to the main routine. If it did not reach the lower limit, "1" is subtracted (n22) from the standard sound pitch buffer STDT (n22), the standard sound pitch is indicated on the indicator 3 (n23), and then the process returns to the main routine.

When the fingering mode selection switch 5*f* is pressed, the mode flag FNGMD is inverted (n24). While this mode flag has been reset, the current mode is the recorder mode but while this flag has not been set, the current mode is the saxophone mode. The currently set system is indicated on the indicator 3 (n25), and the process returns to the main routine. The fingering mode is indicated by ON/OFF of the decimal point of the low-order of the indicator 3 (if it is not lighting, the mode is the recorder mode but if it is lighting, the mode is the saxophone mode). When the indicator selection switch 5*e* is pressed, the indication mode flag DPMD is inverted (n26). At the step n27 the status of this flag is judged. If it has been reset, the indicator indicates the tone color number (FIG. 11 (H): n28). If it has been set, the indicator indicates the standard sound pitch (FIG. 11 (I): n29).

FIGS. 11 (C) to (E) indicate the key pattern detection operation. At first the current key pattern is taken into a key pattern buffer BUF as 15-bit data (n31). The data of BUF is compared with the key pattern (data in a former key pattern buffer OLD) which has been taken in by preceding operation (n32). If an inconsistency is found between these data, it is judged that the key pattern has been changed (sound pitch has been changed), and at the step n33 the key pattern change flag CHG is set, data of BUF is inputted into OLD (n34), and the process returns to the main routine. If (BUF) and (OLD) coincide with each other at the step n32, the process proceeds to the n35 to judge the content of key pattern change flag CHG. If CHG has been reset, this means that the key pattern has not been changed. And the process returns. If CHG has been set, this means that the key pattern has been changed by the preceding operation. Therefore, after the key pattern change flag CHG is reset (n36), the sound pitch change operation of step n37 and on is performed. The sound pitch is not changed soon after the key pattern is changed so as to prevent chattering. That is, although the key pattern is changed so as to change the sound pitch, the key pattern is changed so as to change the sound pitch. ON/-OFF inversion of these two keys is not always performed simultaneously from the viewpoint of CPU 24 (manual operation causes usually insignificant time lag) when ON-OFF is interchanged for more than two keys between the key pattern before change and the key pattern after change. If the sound pitch is changed as soon as the pattern is changed, such a time lag, if it occurs, results in generation of an unnecessary intertone by the key pattern being changed, which disturbs playing of music. Therefore, when the same key pattern is detected twice, it is judged that the key pattern has been fixed, and the sound pitch is changed. In the case when the detection routine is repeated with extremely high speed, it is allowed that the sound pitch is changed when the same key pattern is detected three or more times. At the step n37 the key pattern table is retrieved in (BUF), a key code is searched, and it is inputted into the key code buffer KCD (see FIG. 11 (D)). Then, a reference to the key ON flag KON indicating whether or not play is being performed (whether or not breath intensity is higher than a specific level) is made (n38: described in detail in FIG. 11 (G)). If play is being performed, a sound generating code of sound source 34 is rewritten to this new key code (n39).

FIG. 11 (D) is a flow chart showing in detail the operation of step n37 above. When this operation is started, FNGMD is referenced, and a judgment as to whether the fingering mode is the recorder mode or the saxophone mode is performed (n41). In the recorder mode the operations of steps n42 to n45 are performed, and then the process proceeds to the step n50. In the saxophone mode the operations of steps n46 to n49 are performed, and the process proceeds to the step n50. At the step n42 data of recorder (FPR, FIG. 3) and TNR (FIG. 5) are read into the pattern table start address PP and tone number table buffer TNT, and 88 is inputted as a total number of key patterns. Then (BUF) is read into the processing buffer (BUFA) (n43) to mask the 6th, 7th and 8th bits (corresponding to the playing keys 7-6, 7-7, and 7-8) (n44) because these keys are used only in the saxophone mode but they are not used in the recorder mode. "0" is inputted into the octave parameter buffer BUFB (n45). This is due to that the fact recorder does not have an octave key. In the saxophone mode FPS (FIG. 4) and TNS (FIG. 6) are read into PP and TNT (n46), and BUF is read into BUFA (n47). The high order 2 bits (7-0, 7-1) of BUFA are masked (n48), because these keys are octave keys which do not affect the decision of tone number but affects the decision of octave. After these high-order 2 bits are written in BUFB (n49), the process proceeds to n50. At the step n50 the operation shown in FIG. 11 (E) is performed and the corresponding key pattern is retrieved. If the pertinent key pattern number "i" found by this operation is &HFF, this means that there is no corresponding key pattern. As a result, the process proceeds from n51 to n54, &HFF is inputted into KCD, and returns. If "i" is another value, TNT is retrieved with this value to find the scale tone number, and the found tone number is inputted into a tone number buffer TN (n52). TN, STDT, BUFB×12 are all added and inputted into KCD as key code for the tone to be generated.

FIG. 11 (E) shows the pertinent key pattern retrieving operation. At first, "0" is inputted into a table pointer (pertinent key pattern number) "i", and the pattern data of address (PP+"i") is read into PT (n61). BUFA is compared with PT. If they coincide, the process returns (with a data of "i"). If they do not coincide, a judgment as to whether or not "i" is higher than PN is performed (n63). If it is higher than PN, it is considered that there is no pertinent key pattern, and &HFF is entered into "i", and the process returns (n65). If "i" is less than PN, "1" is added to "i" (n64), and the process returns to n61.

FIG. 11 (F) shows the color tone setting operation. The tone color address table TCA is referenced to with the aid of the selected tone color number, and the top address of pertinent tone color data is read (n66). Tone color data memory is retrieved at this address, and the standard sound pitch is set in STDT (n67). Next, the waveform data is set at the sound source 34 (n68), and then the process returns.

FIG. 11 (G) shows the breath data detecting operation. At first the detected value of the breath sensor is taken into the breath intensity buffer BD (n70). At the step n71 the breath threshold BS and BD are compared. If BD is smaller than BS, it is judged not to be played, and "0" is set in KON and it is sent to the sound source 34. Then the process returns (n76, n77). If BD is larger than BS, the process proceeds to the step n72. At the step 72 whether KON is equal to 1 or 0 at present is judged. If it is equal to 0, this means the beginning of sound generation. Hence, KON is set to 1 (n73), and KCD, BD, KEY ON signal are sent to the sound source (n74). If KON is equal to 1, this means that sound is being generated. Therefore only data of BD is sent (n75). The sound source adjusts the sound volume (level) and vibrato according to (BD).

FIG. 11 (H), (I) and (J) are flow charts indicating the display operation. FIG. 11 (H) shows an indication subroutine which is executed for operation of step n13, n17 or n28. In the case of operation of step n13 and n17 the operation is started at the step n80. DPMD is set to 0, and the process proceeds to the step n81. At the step n81 and n82 the high-order digit of tone color number TC is inputted into the high-order digit display buffer DH whereas the low-order digit of tone color number TC is inputted into the low-order digit display buffer DL. This data is sent to the display section (n83), and at the same time the decimal point LED at the left side of the display is set to OFF (n84), and the process returns.

FIG. 11 (I) shows the operation for indicating the standard sound pitch of this musical instrument. It is executed at the step n20, n23 or n29. When this operation is started at the step n20 or n23, at first "1" is set in DPMD at the step n85. At the step n86 a residue obtained by dividing the standard sound pitch STDT by 12 is taken into the code name buffer CN. The code name table is referenced with the aid of (CN), the tonality (code name) is found, the display data (9 to F and existence or nonexistence of decimal point) is written in the high-order digit display buffer DH (n87). Then, the quotient obtained by dividing STDT by 12 is written into the low-order digit display buffer DL (n88). These data are sent to the display section 27 (n88), and the process returns. The quotient of STDT/12 means an octave to which the standard sound pitch belongs.

FIG. 11 (J) shows the operation for indicating the fingering mode. This operation is executed at the step n25. At the step n94 the fingering mode flag FNCMD is referenced. If it has been reset, the current mode is the recorder mode. Therefore the decimal point of low-order digit goes out (n95). If this flag has been set, the current mode is saxophone mode. Therefore the decimal point of low-order digit is lighted (n96).

This example of an embodiment relates to an electronic musical instrument. The same is valid for keyboard type electronic musical instruments.

Above is the description of the preferred embodiments of the present invention. This invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. An electronic musical instrument, comprising:

a plurality of keys for manual operation by a player;

tone color selecting means for generating tone color data designating a selected one of a plurality of tone colors;

pitch control means responsive to operation of a combination of the plurality of keys within the plurality of keys for generating tone pitch data corresponding to the generated tone color data and to the combination of operated keys; and tone generating means for generating a musical tone having a tone color designated by the tone color data and a tone pitch determined by the tone pitch data;

the pitch control means comprising first memory means for storing a plurality of reference pitch data, each corresponding to the tone color data, means for generating tone pitch data corresponding to the generated tone color data using data from the plurality of reference pitch data which correspond to the generated tone color data, second memory means for storing pattern data which relates the combination of operated keys to different pitch data, and means for generating tone pitch data corresponding to the combination of operated keys by addition of the reference pitch data to the different pitch data corresponding to the combination of operated keys.

2. An electronic musical instrument, comprising:

a plurality of keys for manual operation by a player;

tone color selecting means for generating tone color data designating a selected one of a plurality of tone colors;

pattern memory means for storing plural sets of pattern data which relate combinations of the plurality of keys which are operated to pitch data, each set of pattern data corresponding to one of the plurality of tone colors;

pitch control means responsive to operated keys from the plurality of keys for transforming the combination of operated keys to tone pitch data using one of the plural sets of pattern data selected by the tone color data, the generated tone pitch data corresponding to the combination of operated keys; and tone generating means for generating a musical tone having a tone color designated by the tone color data and a tone pitch determined by the tone pitch data.

3. An electronic musical instrument for generating musical tones having pitches corresponding to combinations of pitch designating operators, comprising:

tone color designating means for designating one of a plurality of tone colors corresponding to one of a plurality of musical tones;

tone pitch storing means for storing standard pitch data for each of the plurality of tone colors, the standard pitch data corresponding to a specific combination of pitch designating operators; and pitch transposing means for transposing a pitch of a musical tone of the plurality of tone colors based on the standard pitch data so that a pitch to be generated corresponding to the specific combination of pitch designating operators and a designated one of a plurality of tone colors becomes a standard pitch therefore.

4. An electronic musical instrument according to claim 3, wherein the standard pitch is the lowest pitch of a musical instrument corresponding to a designated one of the plurality of tone colors.

5. An electronic musical instrument according to claim 3, wherein the specific combination of the pitch designating operators corresponds to a combination of pitch designating operators which are all closed.

6. An electronic musical instrument according to claim 3, further comprising storing means for storing a set of different combinations of the pitch designating operators, the different combinations corresponding to different pitches.

7. An electronic musical instrument according to claim 3, further comprising storing means for storing a plurality of different sets of combinations of the pitch designating operators and for selecting one of the different sets of combinations of the pitch designating operators according to a designated one of the plurality of tone colors, the different sets of combinations corresponding to different pitches.

8. An electronic musical instrument according to claim 3, wherein the plurality of tone colors are those of wind instruments.

* * * * *